US006799862B2

(12) United States Patent
Galli

(10) Patent No.: US 6,799,862 B2
(45) Date of Patent: Oct. 5, 2004

(54) MINIATURE FLASHLIGHT

(76) Inventor: Robert D. Galli, 8176 Horseshoe Bend La., Las Vegas, NV (US) 89113

( * ) Notice: Subject to any disclaimer, the term of this patent is extended or adjusted under 35 U.S.C. 154(b) by 0 days.

(21) Appl. No.: 10/248,266

(22) Filed: Jan. 3, 2003

(65) Prior Publication Data

US 2003/0072151 A1 Apr. 17, 2003

Related U.S. Application Data

(63) Continuation of application No. 09/769,160, filed on Jan. 24, 2001, now Pat. No. 6,523,973, which is a continuation-in-part of application No. 09/374,658, filed on Aug. 16, 1999, now abandoned.

(51) Int. Cl.[7] ..... F21L 4/04

(52) U.S. Cl. ..... 362/201; 362/200; 362/119; 362/116; 362/189; 362/196; 362/208; D26/38; 200/60

(58) Field of Search ..... 362/201, 200, 362/119, 116, 189, 196, 208; D26/38; 200/60

(56) References Cited

U.S. PATENT DOCUMENTS

| | | | | |
|---|---|---|---|---|
| 762,720 | A | 6/1904 | Hubert | |
| 1,047,525 | A | 12/1912 | Hubert | |
| 1,436,340 | A | 11/1922 | Gallagher | |
| 1,866,600 | A | 7/1932 | Rauch | |
| 2,249,692 | A | 7/1941 | Gelardin | |
| 2,412,056 | A | 12/1946 | Mosch | |
| 2,465,114 | A | 3/1949 | Oury | |
| 2,591,112 | A | 4/1952 | Zwierzynski | |
| 2,708,073 | A | 5/1955 | Mohylowski | |
| 2,714,152 | A | 7/1955 | Ackerman et al. | 562/116 |
| 2,762,907 | A | 9/1956 | Schwartz | |
| 2,889,450 | A | 6/1959 | Nordquist et al. | |
| 3,057,992 | A | 10/1962 | Baker | |
| 3,085,149 | A | 4/1963 | Giwosky | |
| 3,085,150 | A | 4/1963 | Bautsch | |
| 3,119,564 | A | 1/1964 | Zalman | |
| 3,256,428 | A | 6/1966 | Schwartz | |
| 3,296,429 | A | 1/1967 | Schwatrz | |
| 3,310,668 | A | 3/1967 | Schwartz | |
| 3,345,508 | A | 10/1967 | Chung | |
| 3,359,411 | A | 12/1967 | Schwartz | |
| 3,613,414 | A | 10/1971 | Ostrager | |
| 3,732,414 | A | 5/1973 | Franc | 240/10.61 |
| 3,804,307 | A | 4/1974 | Johnston | 224/28 |
| 3,866,035 | A | 2/1975 | Richey, Jr. | 240/6.4 |
| 3,870,843 | A | 3/1975 | Witte | 200/302 |
| 4,076,976 | A | 2/1978 | Fenton | 362/104 |
| 4,085,315 | A | 4/1978 | Wolter et al. | 362/116 |
| 4,101,955 | A | 7/1978 | DuNah | 362/104 |
| 4,122,510 | A | 10/1978 | Halliday, Jr. | 362/189 |
| 4,129,899 | A | 12/1978 | Dunbar | 362/109 |
| 4,210,953 | A | 7/1980 | Stone | 362/189 |

(List continued on next page.)

*Primary Examiner*—Stephen Husar
*Assistant Examiner*—Bertrand Zeade
(74) *Attorney, Agent, or Firm*—Barlow, Josephs & Holmes, Ltd.

(57) ABSTRACT

A miniature flashlight consists of a housing, a light emitting diode (LED), a pair of batteries, and a flexible cover and a contact clip that acts as a switch. The LED has a head portion and two contact arms. One of the contact arms is shorter than the other and is displaced at a slight angle relative to the longer contact arm. The LED is received in a seat formed in the housing with the head portion of the diode received in an aperture in the side wall of the housing. The longer contact arm is captured in a channel formed in the bottom wall. The shorter contact arm rests on a shoulder that forms part of the LED seat. A pair of coin cell batteries are received within another seat formed in housing. The lower battery sits on top of the longer contact arm captured in the channel of the bottom wall. A resilient plastic cover is assembled with the housing to maintain the diode and the batteries within the housing.

2 Claims, 10 Drawing Sheets

U.S. PATENT DOCUMENTS 4,228,484 A 10/1980 Johnstone ..... 362/184
4,261,026 A 4/1981 Bolha ..... 362/101
4,276,582 A 6/1981 Burnett ..... 362/116
4,303,966 A 12/1981 Wolter ..... 362/116
4,336,574 A 6/1982 Goodman ..... 362/101
4,346,329 A 8/1982 Schmidt ..... 315/51
4,392,186 A 7/1983 Cziment ..... 362/116
4,398,237 A 8/1983 Doyel ..... 362/186
4,399,495 A 8/1983 Leopoldi et al. ..... 362/189
4,408,261 A 10/1983 Polakoff ..... 362/104
4,422,131 A 12/1983 Clanton et al. ..... 362/186
4,433,365 A 2/1984 Rousseau ..... 362/189
4,517,627 A 5/1985 Bradford ..... 362/156
4,521,833 A 6/1985 Wolter ..... 362/116
4,524,409 A 6/1985 Yakubek
D285,989 S 10/1986 MacDonald
4,628,418 A 12/1986 Chabria
D290,518 S 6/1987 Rakocy et al.
4,731,712 A 3/1988 Amthor ..... 362/189
4,768,138 A 8/1988 Leopoldi et al. ..... 362/189
4,787,016 A 11/1988 Song
4,893,222 A 1/1990 Mintzer ..... 362/109
D311,067 S 10/1990 Chabria
5,008,784 A 4/1991 Wang ..... 362/116
5,029,055 A 7/1991 Lindh ..... 362/191
5,043,854 A 8/1991 Gammache ..... 362/197
5,122,943 A 6/1992 Pugh
5,143,442 A 9/1992 Ishikawa et al.
5,158,356 A * 10/1992 Guthrie ..... 362/188
D337,200 S 7/1993 Keller
5,285,586 A 2/1994 Goldston et al. ..... 36/137
5,318,177 A 6/1994 Isacson
5,386,351 A 1/1995 Tabor ..... 362/201
5,457,613 A 10/1995 Vandenbelt et al. ..... 362/200
5,463,539 A 10/1995 Vandenbelt et al.
5,465,197 A 11/1995 Chien ..... 362/203
5,475,368 A 12/1995 Collins ..... 340/573
5,515,248 A 5/1996 Canfield et al.
5,541,817 A 7/1996 Hung ..... 362/116
D372,356 S 8/1996 Marguerite
D381,803 S 8/1997 Crego ..... D3/208
5,730,013 A 3/1998 Huang
D394,345 S 5/1998 Marguerie
D400,326 S 10/1998 Fisher ..... D32/42
D401,371 S 11/1998 Chen
D402,069 S 12/1998 Chan
5,893,631 A 4/1999 Padden ..... 362/201
5,894,196 A 4/1999 McDermott ..... 313/512
5,927,846 A 7/1999 Sinclair
5,934,789 A 8/1999 Sinclair
5,956,985 A 9/1999 Chang ..... 70/456
6,006,562 A 12/1999 Wolter
6,039,454 A 3/2000 Hallgrimsson
6,070,990 A 6/2000 Dalton et al.
6,079,845 A 6/2000 Kreider
6,109,762 A 8/2000 Hallgrimsson et al. ..... 362/200
6,164,795 A 12/2000 Lopez ..... 362/116
6,190,018 B1 2/2001 Parsons et al. ..... 362/116
6,582,097 B2 * 6/2003 Chang ..... 362/253

* cited by examiner

MINIATURE FLASHLIGHT

CROSS REFERENCE TO RELATED APPLICATIONS

This Application is a continuation of Application Ser. No. 09/769,160 filed Jan. 24, 2001, now U.S. Pat. No. 6,523,973, which is a continuation in part of application Ser. No. 09/374,658 filed Aug. 16, 1999, now abandoned.

BACKGROUND OF INVENTION

The instant invention relates to miniature lighting devices, such as key lights, and small personal flashlights, and more particularly to miniature flashlight of the type employing a high brightness light emitting diode.

The recent development of low cost, high brightness diodes, i.e. light emitting diodes, or LED's has provided light manufacturers with a new alternative to conventional filament light bulbs as a light source in flashlights and other types of small personal lights. While there are many different types and kinds of lights, there is always a need for newer constructions and arrangements which reduce the number of parts, simplify manufacturing procedures, and ultimately reduce cost.

SUMMARY OF INVENTION

In this regard, the instant invention provides an improved miniature flashlight construction comprising a housing, a light emitting diode (LED), a pair of batteries, a flexible cover, and a contact device mounted on the inside of the housing that acts as a switch. The housing includes a bottom wall, and a continuous side wall extending upwardly from the bottom wall. The bottom wall and side wall cooperate to form an upwardly opening interior cavity for receiving the batteries, and LED therein. The LED has a head portion and two spaced contact arms extending rearwardly from the head portion. One of the contact arms is shorter than the other and is used as part of the switch mechanism. A conventional LED is provided with two identical contact arms.

The shorter contact arm is created by trimming the contact arm. The LED is received in a seat formed in the housing with the head portion of the diode received in an aperture in a side wall of the housing. The longer contact arm extends along the bottom wall of housing and is captured in a longitudinal channel formed in the bottom wall. The shorter contact arm rests on a raised shoulder that is formed as part of the LED seat. A pair of coin cell batteries are piggy backed and received within another seat formed in housing. The lower contact surface of the lower battery sits on top of the longer contact arm captured in the channel of the bottom wall. The contact device is installed into a groove in the raised shoulder thereby contacting the shorter contact arm and retaining the LED. The resilient plastic cover is frictionally received in assembled relation with the side walls of the housing to maintain the batteries within the housing. The first end of the contact device engages the shorter contact arm of the second contact of the diode, while the opposing second end is disposed in spaced relation over the upper surface contact of the upper battery The cover is selectively depressible, i.e. deformable, to selectively move the second end of the contact device into electrical communication with the upper surface of the battery to selectively energize the diode.

Accordingly, among the objects of the instant invention are: the provision of small, lightweight, low cost flashlight having a superior brightness level, and extended longevity; the provision of a miniature flashlight construction that utilizes a high brightness LED as a light source; the provision of a miniature flashlight that uses a resilient housing portion as part of the switch arrangement; the provision of a miniature flashlight having a reduced number of parts; and the provision of a miniature flashlight that can be disassembled to replace spent batteries.

Other objects, features and advantages of the invention shall become apparent as the description thereof proceeds when considered in connection with the accompanying illustrative drawings.

BRIEF DESCRIPTION OF DRAWINGS

In the drawings which illustrate the best mode presently contemplated for carrying out the present invention.

DETAILED DESCRIPTION

Figure 1:
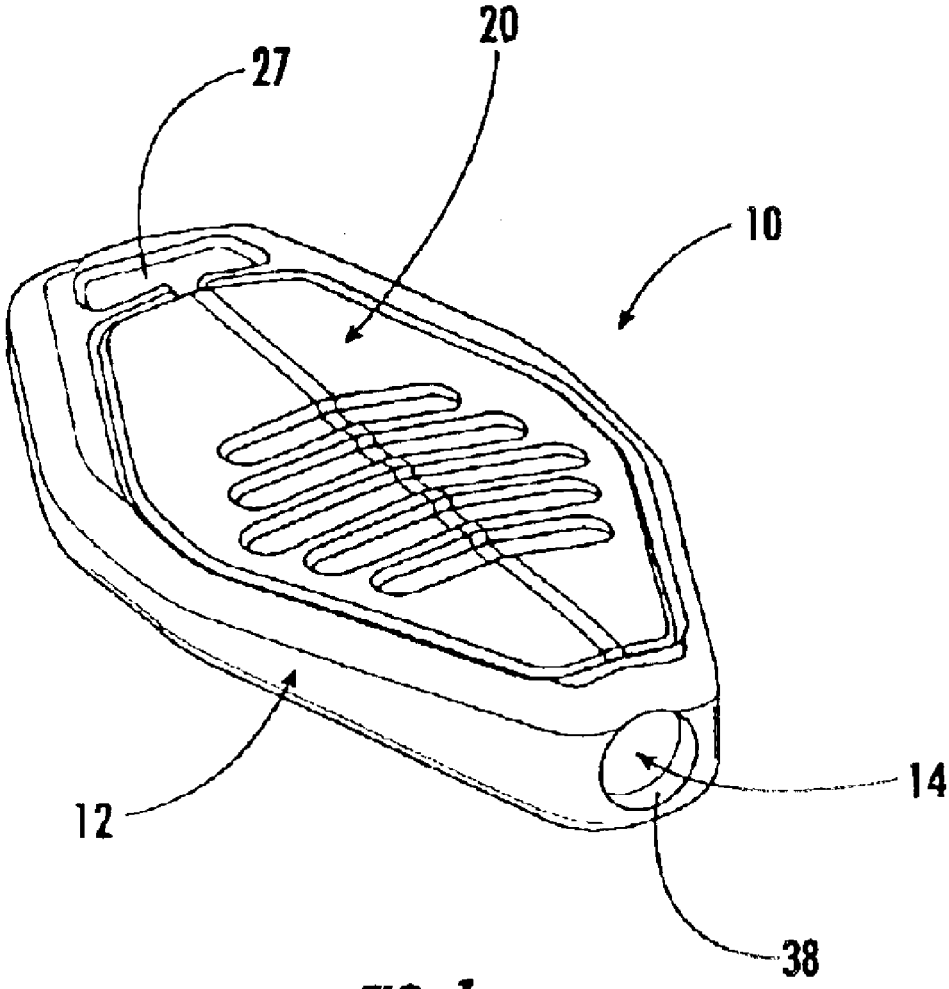
FIG. 1 is a perspective view of a first embodiment of the miniature flashlight of the present invention.
Figure 2:
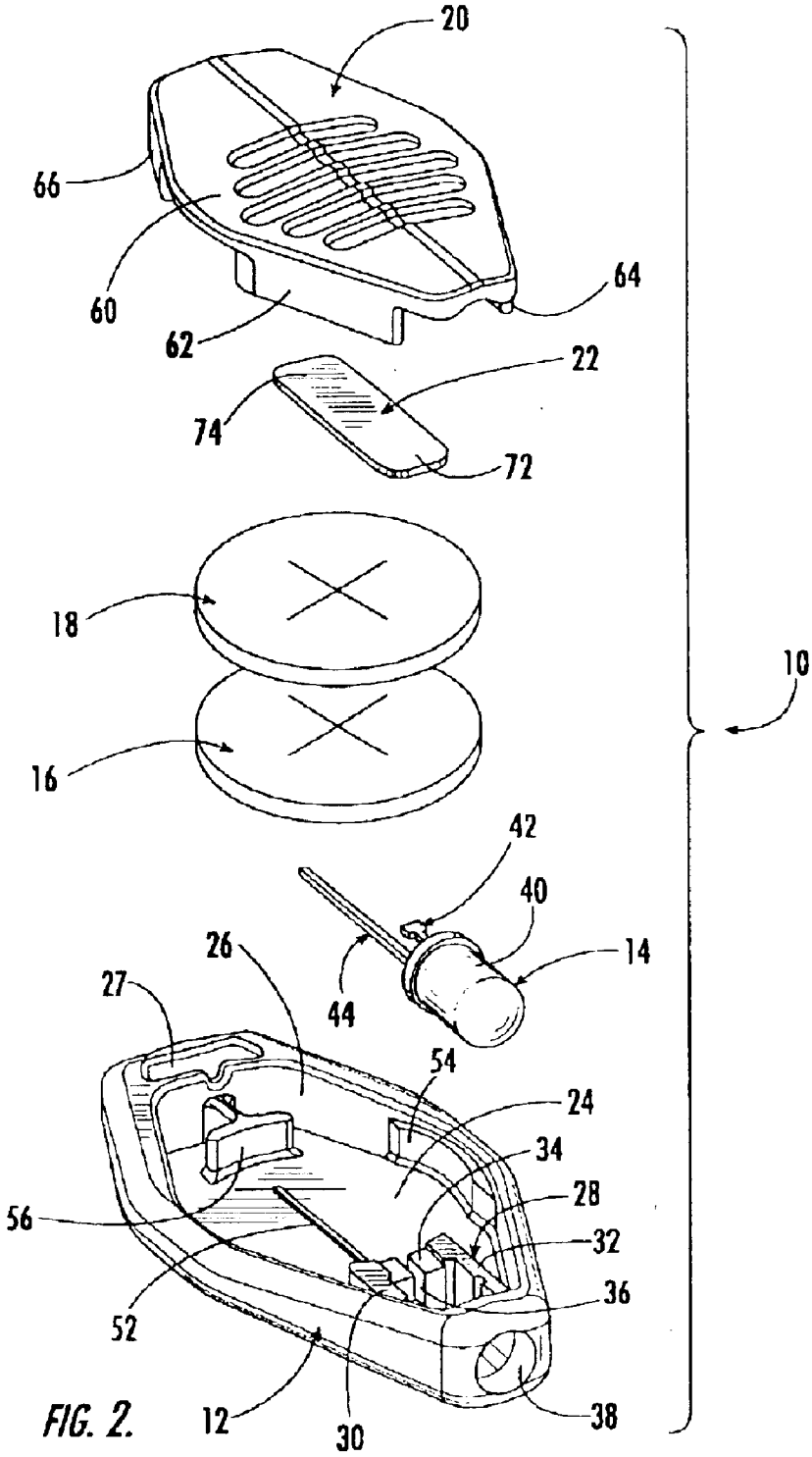
FIG. 2 is an exploded perspective view thereof.
Figure 3:
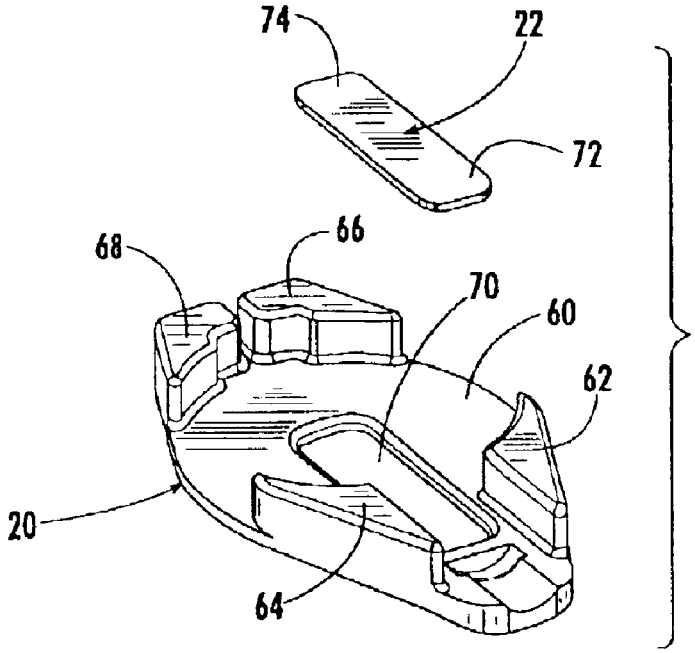
FIG. 3 is an exploded perspective view of the cover assembly thereof.

Referring now to the drawings, a first embodiment of the miniature flashlight of the instant invention is illustrated and generally indicated at 10 in FIGS. 1–10. As will hereinafter be more fully described, the instant invention utilizes a high brightness light emitting diode, and long life lithium coin cell batteries in a simple housing to provide a useful, novel and improved flight source.

The flashlight 10 comprises comprising a housing generally indicated at 12, a light emitting diode (LED) generally indicated at 14, a pair of batteries respectively generally indicated at 16 and 18, a cover generally indicated at 20, and in the first embodiment, a contact strip 22 mounted on the inside of the cover 20.

The housing 12 is generally diamond shaped and is preferably molded from a rigid plastic material suitable for housing the types of electronic components discussed herein. Generally speaking the housing 12 is approximately the same size as a conventional keyless alarm device provided for many vehicles. However, it is noted that this size is not critical to the device, and is not intended to limit the scope of the disclosure in any way. The housing 12 includes a bottom wall 24, and a continuous side wall 26 extending upwardly from the bottom wall 24. The bottom wall 24 and side wall 26 cooperate to form an upwardly opening interior cavity for receiving the batteries 16, 18, and LED 14 therein. The housing 12 further includes an external aperture 27 in the rear end for receiving a key chain or other type of clip, and an internal seat generally indicated 28 at for receiving the LED 14. The seat 28 is formed by two vertical side walls 30, 32 and a rear wall 34 extending upwardly from the bottom wall 24. The rear wall 34 includes a slot 36 for receiving the contact arms of the LED 14 when inserted into the seat 28. The front of the seat 28 opens into a longitudinally extending aperture 38 sized to receive a head portion of the LED 14.

Figure 4:
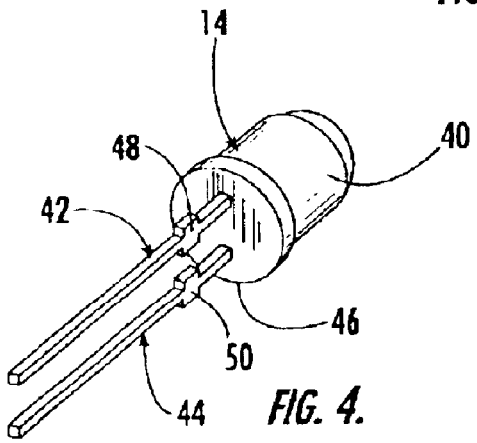
FIG. 4 is a perspective view of the LED thereof prior to trimming of the upper contact.
Figure 5:
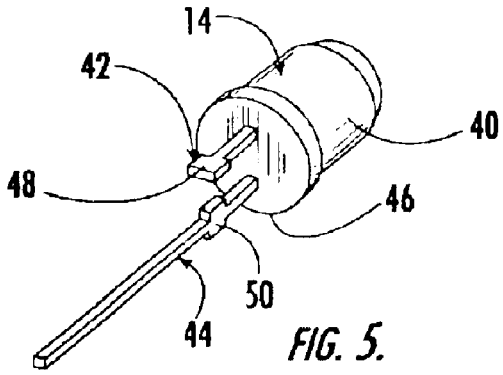
FIG. 5 is another perspective view of the LED thereof after trimming of the upper contact.
Figure 6:
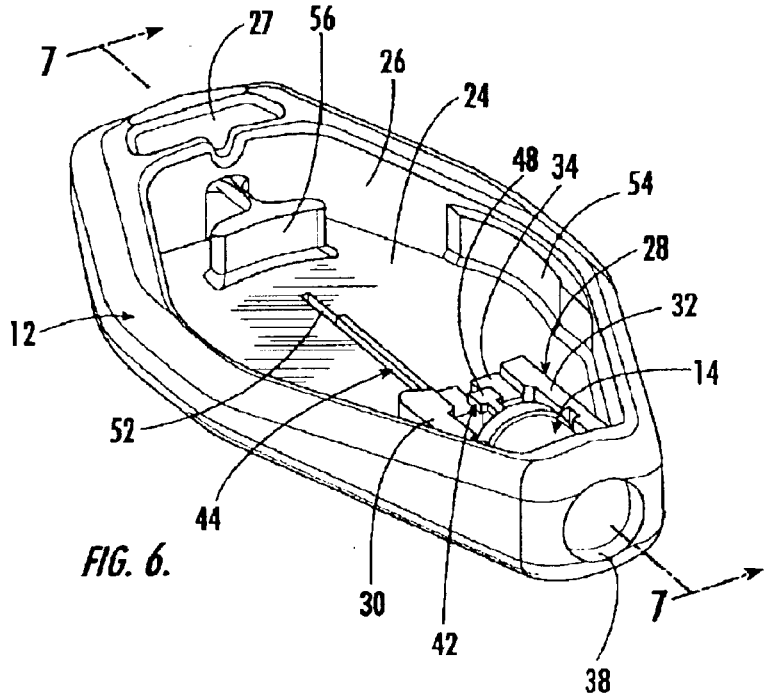
FIG. 6 is a perspective view of the housing thereof with the cover assembly and batteries removed.
Figure 7:
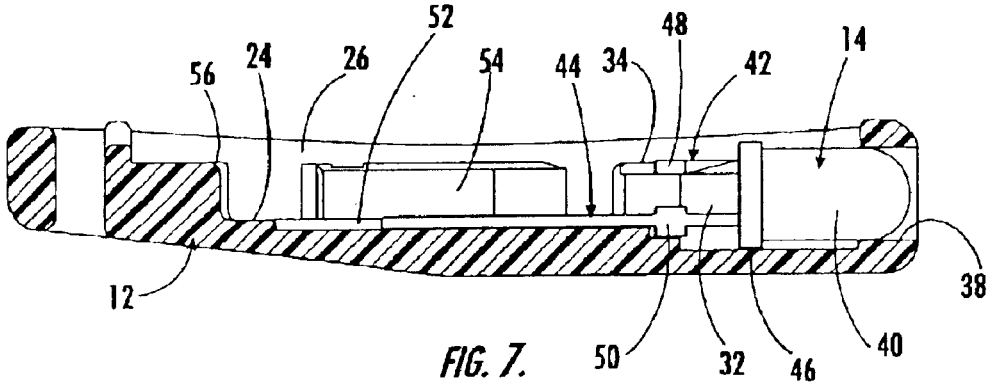
FIG. 7 is a cross-sectional view thereof as taken along line 7—7 of FIG. 6.
Figure 8:
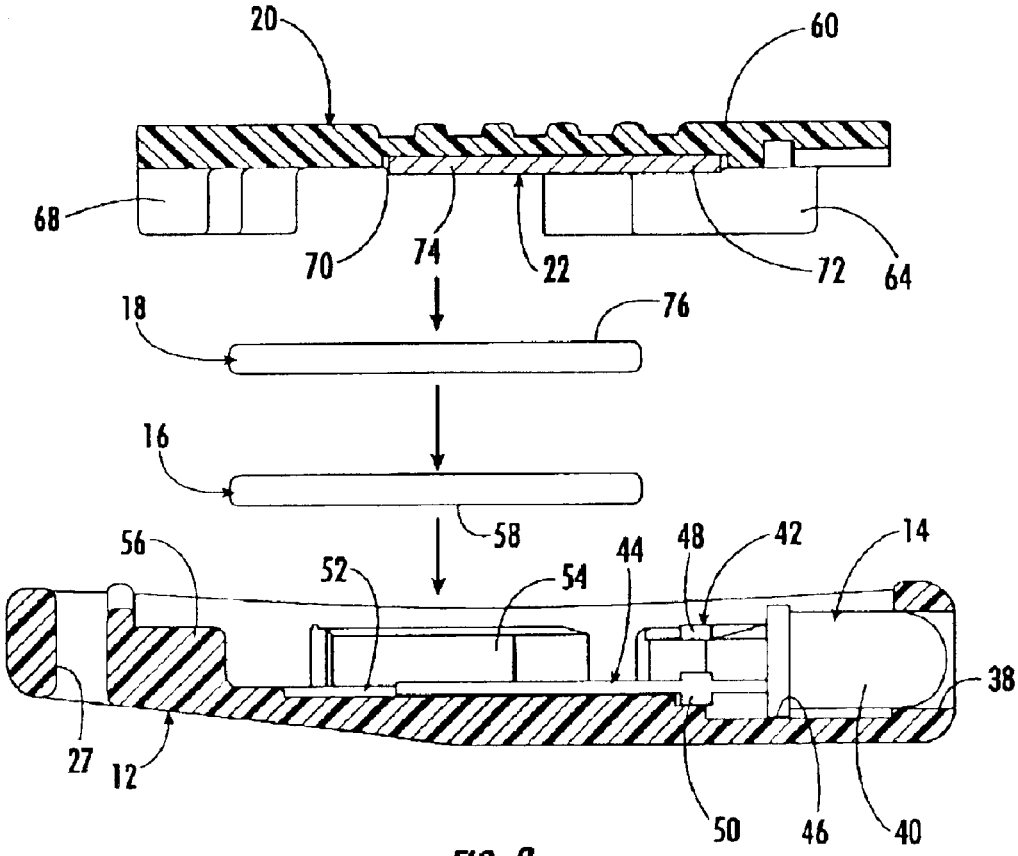
FIG. 8 is another cross-sectional view thereof showing insertion of the batteries and cover assembly.

Referring to FIGS. 4 and 5, the LED 14 preferably comprises a high brightness, gallium nitride LE. The gallium LED 14 emits a soft blue wavelength of light that is particularly suitable for use as a multipurpose flashlight. The gallium LED 14 typically requires an operating voltage of about 4.5 volts which thus requires the use of two 3.0 volt lithium coin cells 16 and 18 (CR2016). Other types of LED's are also suitable, such as gallium phosphide red and green LED's. These LED's typically have an operating voltage of about 2.0 volts and require only a single lithium coin cell (CR2032) (not shown). The LED's and batteries are interchangeable in the present configuration so that manufacturing is not limited to single source suppliers. The shape of an LED 14 is standard throughout the industry comprising a head portion 40 and two spaced contact arms generally indicated at 42, 44 extending rearwardly from the head portion 40. The head portion 40 further includes a flat shoulder 46 which can be used for alignment of the head 40 in assembly. For assembly in the housing 12, one of the contact arms 42 is shorter than the other 44, and in the first embodiment includes a contact plate, i.e. stop plate, 48 that is used as part of the switch mechanism. Referring to FIG. 4, a conventional LED is provided with two identical contact arms 42, 44 each having a stop plate 48, 50 adjacent to the head portion 14. The stop plates 48, 50 are typically used as a shoulder stop when inserting the LED 14 into a circuit board. The shorter contact arm 42, as illustrated in FIG. 5, is created by trimming the contact arm 42 at the end of the stop plate 48 and rotating the contact arm 42 by 90 degrees so that the stop plate 48 is presented for use as a horizontal contact plate. Turning to FIGS. 6, 7 and 8, the LED 14 is received in the seat 28 with the head portion 40 thereof received in the aperture 38. The longer contact arm 44 is slid into the slot 36 in the rear wall 35 of the seat and extends along the bottom wall 24 of housing 12 where it is captured in a longitudinal channel 52 formed in the bottom wall 24. In FIG. 8 it can be seen that the upper edge of the contact arm 44 projects upwardly above the surface of the bottom wall 24 to engage the batteries 16, 18 to be inserted into the housing 12. The stop plate 50 of the longer contact arm 44 rests within the slot 36 in the seat, and the stop plate 48 of the shorter contact arm 42 rests on top of the rear wall 34 bridging the slot 36 that receives the longer arm 44.

Figure 9:
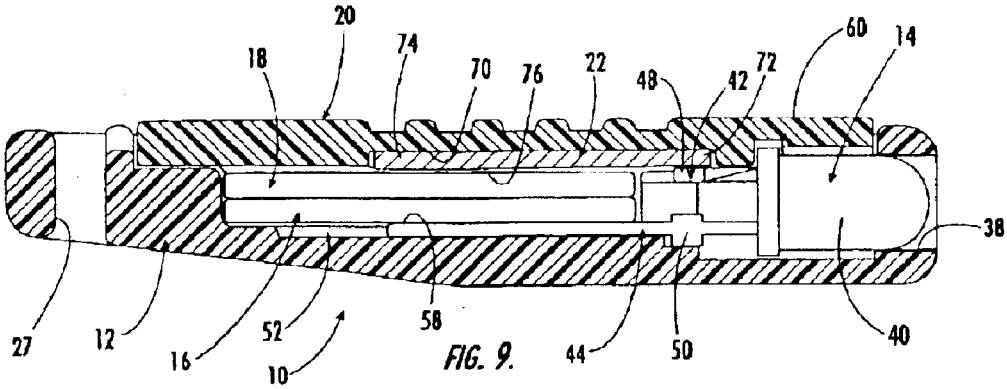
FIG. 9 is a cross-sectional view of the assembled flashlight as taken along line 9—9 of FIG. 1.
Figure 10:
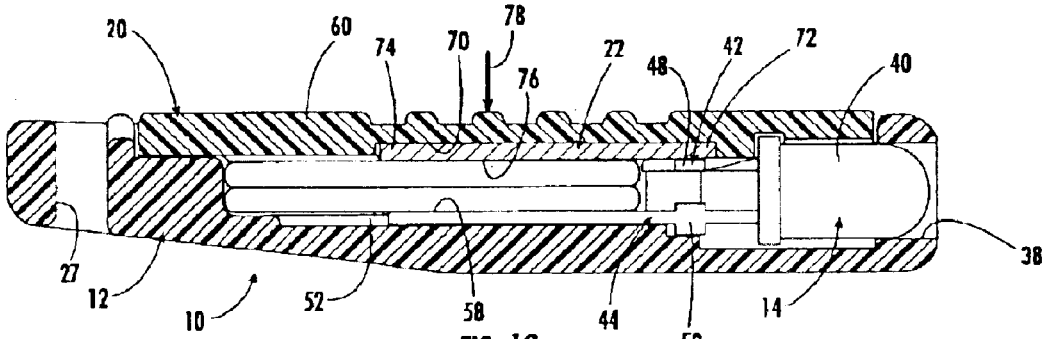
FIG. 10 is another cross-sectional view showing depression of the cover assembly and closure of the electrical circuit to energize the LED.
Figure 11:
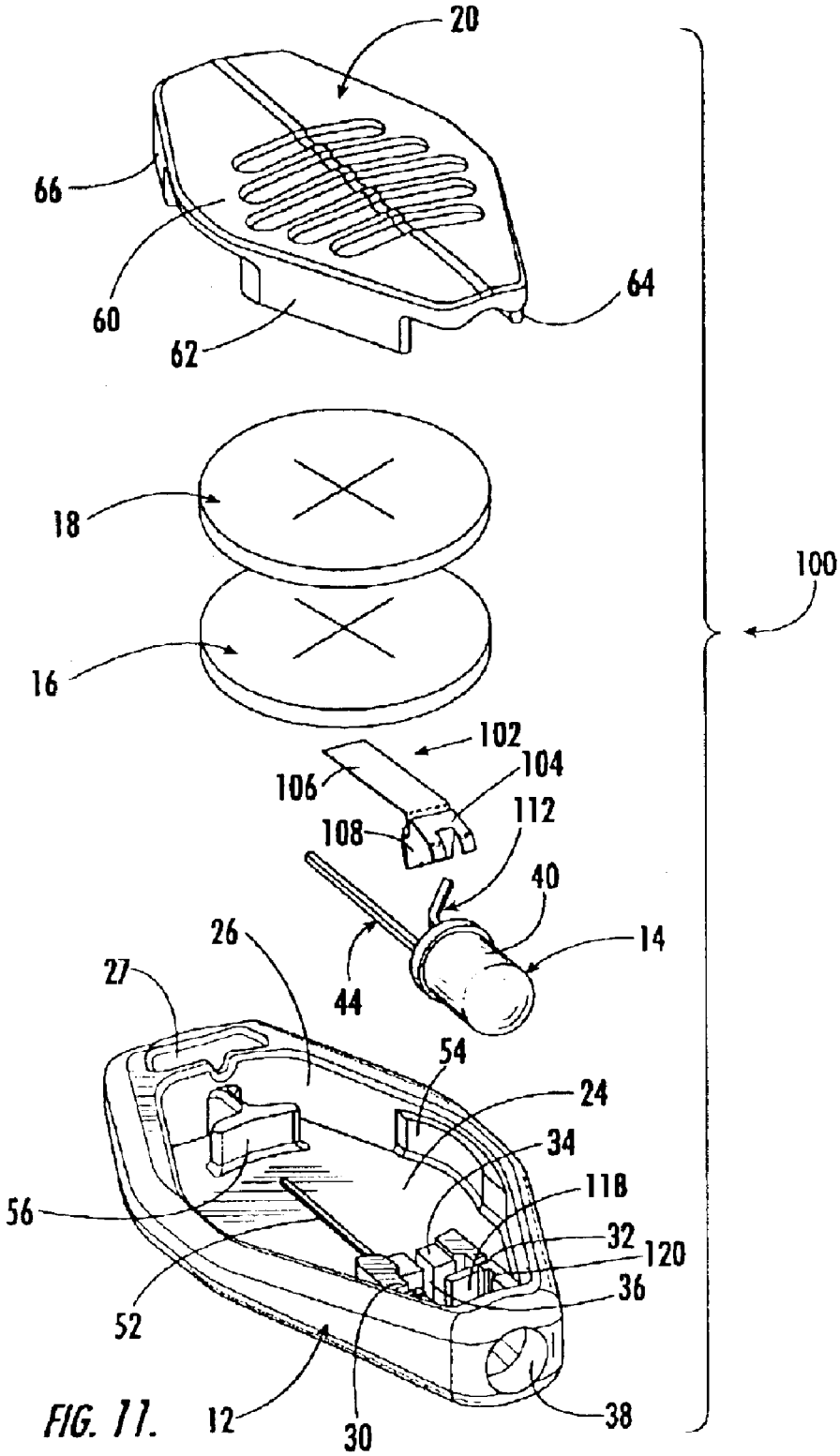
FIG. 11 is an exploded perspective view of a second embodiment of the miniature flashlight.
Figure 12:
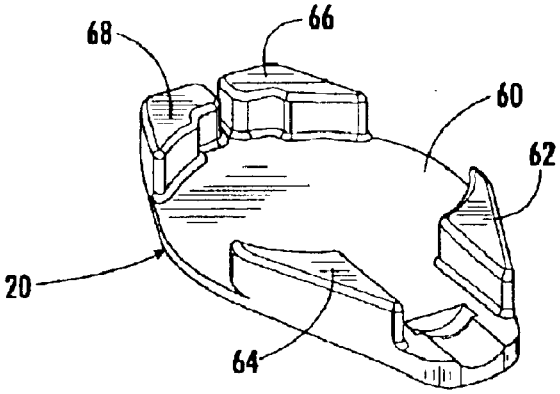
FIG. 12 is a perspective view of the cover thereof.

As indicated above, the coin cell batteries 16, 18 comprise a pair CR2016 lithium batteries that are piggy backed and received into the housing 12. In this regard, the side wall 26 of the housing 12 is provided with symmetrically opposed side shoulders 54 (only one shown) and rear shoulder 56 that cooperate to position the batteries 16, 18 within the housing 12. Referring now to FIGS. 8–10, the lower contact surface 58 of the lower battery 16 sits on top of the longer contact arm 44 captured in the channel 52 of the bottom wall 24.

The cover 20 is generally diamond shaped to match the housing 12 and is preferably molded from a resilient plastic, or elastomeric material, that is capable of flexing. The cover 20 includes a top wall 60, and symmetrically opposed insert legs 62, 64, and 66, 68 that are sized and configured to be received in assembled relation within the interior surfaces of the side wall 26 of the housing 12. In this regard, the cover 20 is maintained in position by friction between the outside surfaces of the insert legs 62, 64, 66, 68 and the interior surfaces of the side walls 16. The existing friction is sufficient to maintain the cover 20 in position, yet will allow the cover 20 to be removed when the batteries 16, 18 need to be replaced.

The contact strip 22 is mounted in a recess 70 on the inside surface of the top wall 60. When the cover 20 is assembled with the housing 12, the first end 72 of the contact strip 22 engages the stop plate 48 of the short contact 42 of the diode 14, while the opposing second end 74 of the contact strip is disposed in spaced relation over the upper surface 76 contact of the upper battery 18 (See FIG. 9).

Referring to FIGS. 9 and 10, the contact strip 22 is normally spaced over the upper surface 76 of the upper battery 18 to maintain the circuit in an open condition. However, the center portion of the top wall 60 of the cover 20 is depressible, i.e. resiliently deformable, upon downward pressure (see arrow 78 FIG. 10), to selectively move the second end 74 of the contact strip 22 into electrical communication with the upper surface 76 of the upper battery 18 to close the circuit and selectively energize the diode 14. Release of pressure from the cover 20 allows the cover 20 to return to its normal shape (FIG. 9) and withdraws the contact strip 22 from engagement with the battery 18.

Referring now to FIGS. 11–18 a second embodiment of the invention is illustrated and generally indicated as 100. The construction of the flashlight 100 is generally the same as in the first embodiment 10, with a few variations in the housing, circuitry and switch mechanism.

In the second embodiment, the contact strip 22 is replaced with a combination retaining clip and spring biased contact generally indicated at 102, and the orientation of the LED contacts is slightly different to accommodate the retaining clip 102.

Figure 15:
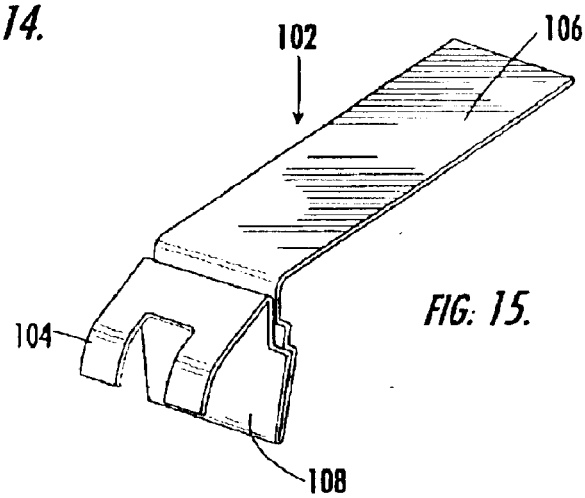
FIG. 15 is perspective view of the contact clip thereof.

The retaining clip 102, shown in FIG. 15, comprises a unitary strip of spring metal being bent in such a fashion to serve as a retainer and a spring biased contact switch. The retaining clip 102 has three distinct portions having a stationary end 104, a movable end 106 and an intermediate portion bent over on itself to form a spring tab 108. The stationary end is bent downwardly and includes a slot at the forward end for receiving a contact of the LED, the relationship of which will be described hereinafter.

Figure 13:
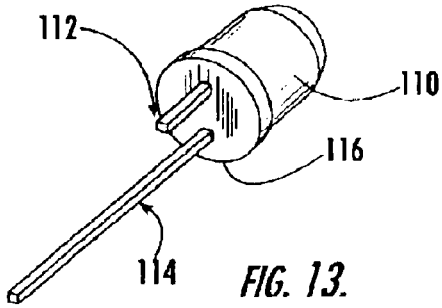
FIG. 13 is a perspective view of the LED thereof after trimming of the upper contact.
Figure 14:
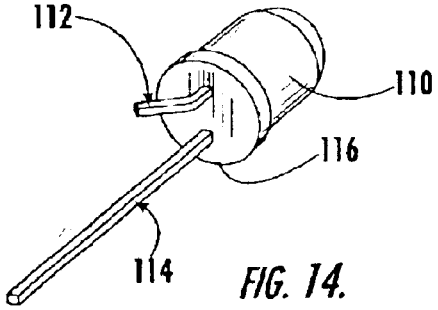
FIG. 14 is a perspective view of the LED after bending of the upper contact.

The LED shown in FIGS. 13 and 14 comprises a head portion 110 and two spaced contact arms generally indicated at 112, 114 extending rearwardly from the head portion 110. The head portion 110 further includes a flat shoulder 116 which can be used for alignment of the head 110 in assembly. For assembly in the housing 12, the upper contact arm 112 is shorter than the other 114, and is bent at a slight angle as illustrated in FIG. 14 so that it will rest on the intermediate shoulder 118. Referring to FIG. 13, a conventional LED is provided with two identical contact arms 112, 114 adjacent to the head portion 110. The shorter contact arm 112 is created by trimming the contact arm 112 at and bending the contact arm 112 a few degrees out of the plane that aligns with the longer contact arm 114 so that when the LED 110 is installed in the housing 12 the shorter arm rests on an intermediate shoulder 118 of the seat 28 of the housing 12 and is presented for use as a contact point.

Figure 16:
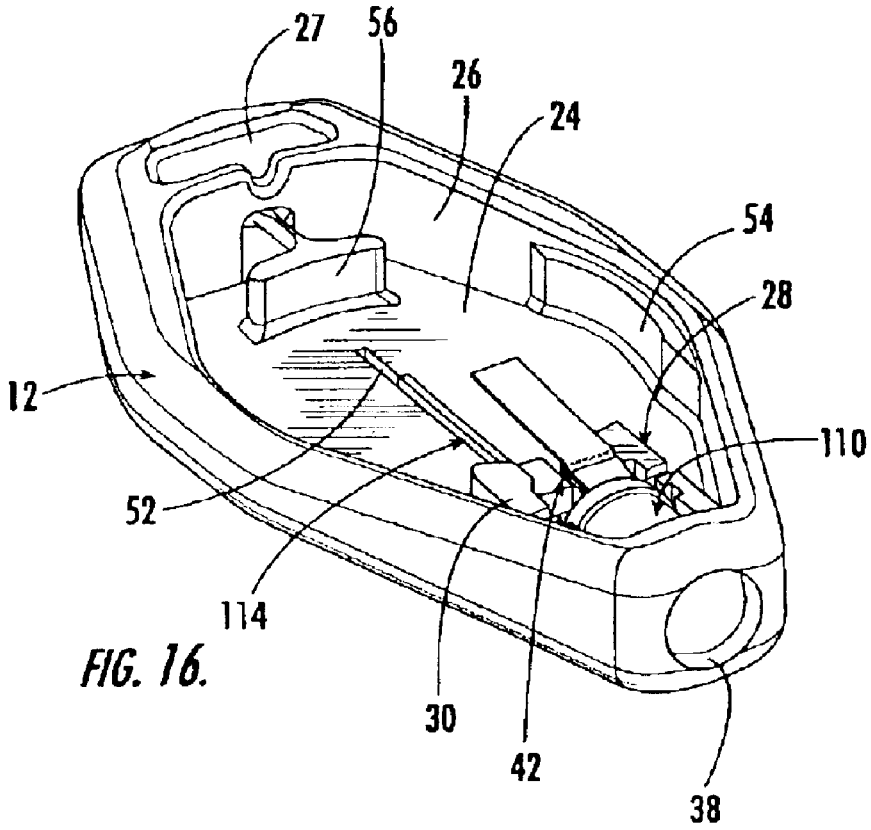
FIG. 16 is a perspective view of the housing with the cover assembly, contact clip and batteries removed.
Figure 17:
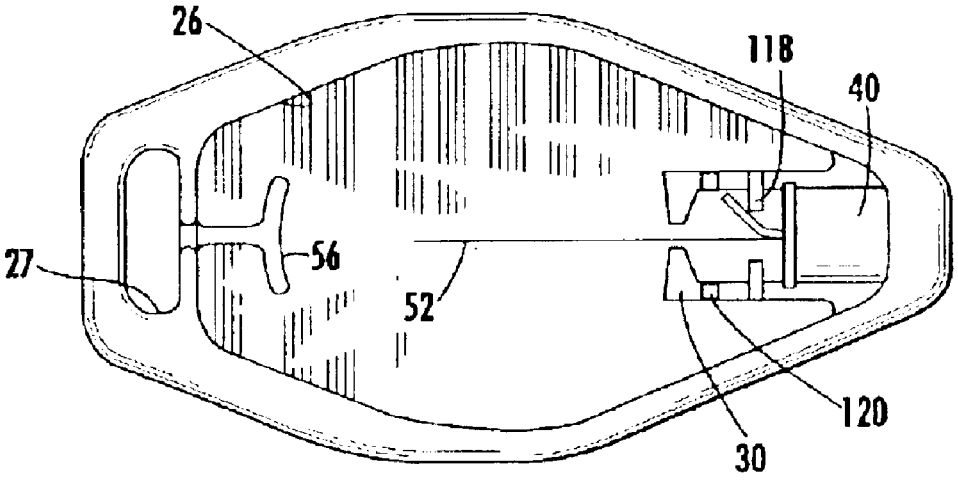
FIG. 17 is a top view thereof showing location of the LED and contacts.

Turning to FIGS. 16 and 17, the seat 28 for the LED is also slightly different to accommodate and receive the spring tab 108 of the retaining clip 102. In this regard, the seat 28 for the LED is formed by two vertical side walls 30, 32, a rear wall 34 and an intermediate shoulder 118 extending upwardly from the bottom wall 24. The rear wall 34 includes a slot 36 for receiving the longer contact arm 114 of the LED 110 when inserted into the seat 28. The front of the seat 28 opens into a longitudinally extending aperture 38 sized to receive a head portion of the LED 110.

Figure 18:
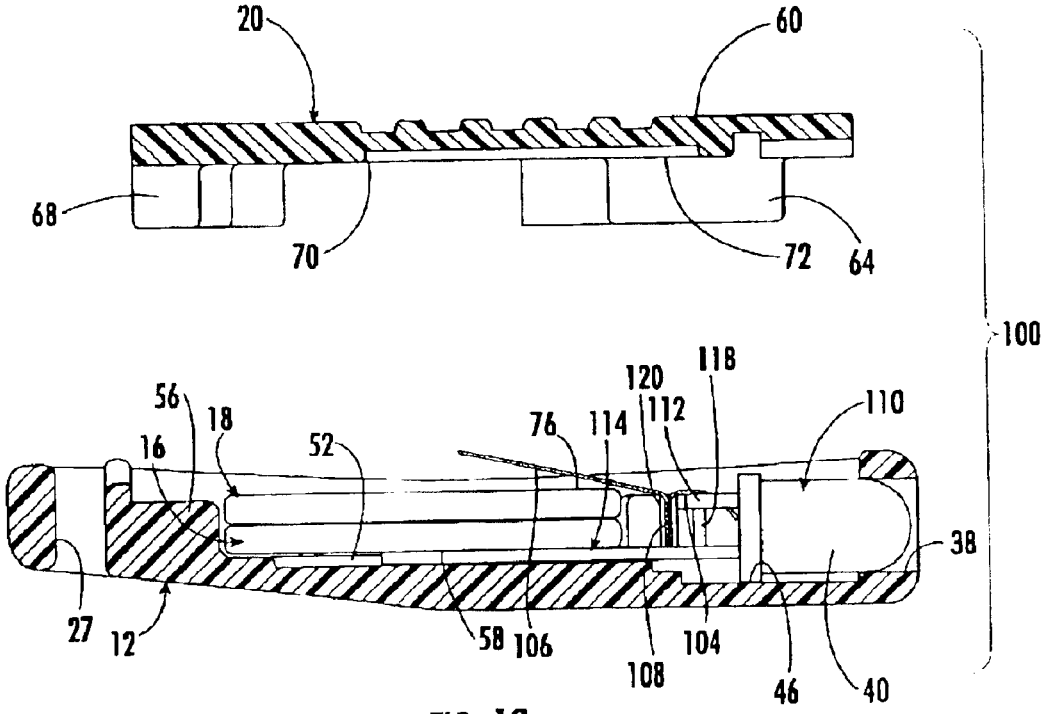
FIG. 18 is a cross-sectional assembly view thereof showing assembly of the batteries, contact clip and cover assembly.

The LED 110 is received in the seat 28 with the head portion 110 thereof received in the aperture 38. The longer contact arm 114 is slid into the slot 36 in the rear wall 35 of the seat and extends along the bottom wall 24 of housing 12 where it is captured in a longitudinal channel 52 formed in the bottom wall 24. In FIG. 18 it can be seen that the upper edge of the contact arm 114 projects upwardly above the surface of the bottom wall 24 to engage the batteries 16, 18 to be inserted into the housing 12. The shorter contact arm 112 rests on top of the intermediate shoulder 118.

The spring tab 108 of the retaining clip 102 (shown in FIG. 15) is frictionally inserted into a groove 120 in the side walls 30, 32 of the seat 28 with a stationary contact end 104 being in electrical communication with the shorter LED contact arm 112. The stationary contact end of the contact clip 104 presses onto the shorter contact arm 112 retaining it against the intermediate shoulder 118. This arrangement forms a biased engagement of the clip and contact to form a reliable circuit connection.

Referring to FIG. 18, the movable end 106 of the contact clip 102 is normally spaced over the upper surface 76 of the upper battery 18 to maintain the circuit in an open condition. However, the center portion of the top wall 60 of the cover 20 is depressible, i.e. resiliently deformable, upon downward pressure (see arrow 78 FIG. 10), to selectively move the second end 106 of the contact clip 102 into electrical communication with the upper surface 76 of the upper battery 18 to close the circuit and selectively energize the diode 14. Releasing of pressure from the cover 20 allows the cover 20 to return to its normal shape and releases the movable end 106 of the contact clip 102 from engagement with the battery 18.

It can therefore be seen that the instant invention provides a small, lightweight, low cost flashlight 100 having a superior brightness level, and extended longevity. The use of a high brightness LED as a light source provides a long life light source, and the use of lithium batteries extends the normal longevity of such miniature flashlights. The simple construction and mounting of the LED, and switch configuration permit inexpensive manufacturing and further provide the ability to easily replace the batteries and extend the longevity of the flashlight. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A flashlight assembly comprising:

a coin cell battery having first and second contact surfaces;

a lighting element having first and second contact leads, wherein at least said first contact lead is shortened, a frame having a bottom wall and a plurality of wall structures extending upwardly from said bottom wall, said bottom wall and said wall structures cooperating to define a seat for receiving said lighting element and a cavity for receiving said coin cell battery, said plurality of wall structures including a dividing wall that separates said lighting element seat and said battery cavity, said shortened first contact lead being received and supported on said dividing wall when said lighting element is received in said seat;

a cover having a top wall adapted to overlie and substantially close said cavity, said frame and said cover including mating formations that interfittingly engage to retain said frame and said cover in assembled relation; and an electrically conductive contact member received in assembled relation within said frame and said cover and overlying said dividing wall, said contact member having a first contact surface in fixed electrically conductive engagement with said shortened first contact lead whereby said shortened first contact lead is captured between said dividing wall and said first contact surface of said contact member, said contact member further having a second contact surface electrically engageable with said first contact of said battery.

2. A housing for a flashlight assembly comprising:

a frame including a bottom wall and a plurality of wall structures extending upwardly from said bottom wall, said bottom wall and said wall structures cooperating to define a seat for receiving a lighting element and a cavity adjacent to said seat for receiving a coin cell battery, said plurality of wall structures including a dividing wall that separates said lighting element seat and said battery cavity, said dividing wall supporting at least one shortened contact lead of a lighting element when said lighting element is received in said seat;

a cover having a top wall adapted to overlie and substantially close said cavity, said frame and said cover including mating formations that interfittingly engage to retain said frame and said cover in assembled relation; and an electrically conductive contact member received in assembled relation within said frame and said cover and overlying said dividing wall, said contact member having a first contact surface receivable in fixed electrically conductive engagement with said at least one shortened contact lead of said lighting element, and further having a second contact surface electrically engageable with a battery.

* * * * *